United States Patent [19]

Hollingsworth

[11] Patent Number: 4,513,560

[45] Date of Patent: Apr. 30, 1985

[54] SKIN PACKAGING MACHINE WITH INCLINED OVEN

[75] Inventor: Alexander Hollingsworth, Anderson, S.C.

[73] Assignee: Nordson Corporation, Amherst, Ohio

[21] Appl. No.: 265,674

[22] Filed: Jun. 1, 1981

[51] Int. Cl.[3] ..... B65B 11/52

[52] U.S. Cl. ..... 53/509; 53/427; 53/511

[58] Field of Search ..... 53/433, 511, 427, 509

[56] References Cited

U.S. PATENT DOCUMENTS

| | | | |
|---|---|---|---|
| 2,991,600 | 7/1961 | Lancaster | 53/433 |
| 3,550,348 | 12/1970 | Rorer | 53/509 |
| 3,587,200 | 6/1971 | Stone | 53/509 X |
| 3,709,702 | 1/1973 | Mahaffy | 53/427 X |
| 3,988,093 | 10/1976 | Birchenough | 53/509 X |

*Primary Examiner*—A. J. Heinz

*Attorney, Agent, or Firm*—Wood, Herron & Evans

[57] ABSTRACT

A skin packaging machine having a base, an inclined oven above the base, and a film frame pivoted to swing between the base and the inclined oven. The oven has transverse elongated heating elements closely spaced at the lower end and widely spaced at the upper end to provide uniform heat across the surface of the oven. The frame has a pneumatic system for swinging it between its upper and lower positions in order to minimize the possibility of injury.

1 Claim, 5 Drawing Figures

SKIN PACKAGING MACHINE WITH INCLINED OVEN

This invention relates to a skin packaging machine.

Skin packaging machines generally have included a base presenting a horizontal foraminous surface with means for drawing a vacuum through that foraminous surface. A horizontal oven is spaced well above the foraminous surface. A horizontal frame is located between the base and the oven and is provided with a mechanism for raising and lowering the frame. A supply roll of film is provided adjacent the frame and film is fed between two jaws which form the frame. That film is raised, by the frame, to a position adjacent the oven and when it becomes sufficiently heated to droop, the frame is lowered to bring the film down upon a substrate and an article placed thereon which is resting on the foraminous surface. A vacuum is applied to the foraminous surface and the substrate, thereby pulling the film snugly down onto the substrate and enclosing the article between the film and the substrate.

The frame must be mounted on special guides in order to keep it horizontally aligned with the oven and the base. Further, the space between the oven and the base is somewhat confining thereby making somewhat difficult the operations of the operator in placing a fresh substrate and article on the base and removing it after the packaging operation has been completed.

An objective of the present invention has been to provide an improved oven structure wherein the necessity of the guides and expensive transmission for the frame is substantially eliminated and further to provide a greater access to the work space between the oven and the base.

Another objective of the present invention has been to provide a more uniform heating of the film when it is placed adjacent the oven.

Still another objective of the invention has been to provide a pneumatic system for raising and lowering the frame so as to minimize the possibility of injury to the operator by virtue of the frame clamping the operator's hand between the frame and the oven or base.

These objectives of the invention are attained by providing an oven whose opening is inclined at a substantial angle as, for example, 40° to the base. The frame is pivoted adjacent the lower end of the oven and is oriented so that it can swing from a horizontal position immediately overlying the base to an upwardly inclined position inmediately adjacent the opening of the oven. By providing an inclined oven and a pivoted frame, the need for an expensive guide arrangement in order to maintain the frame in its horizontal attitude and aligned with the oven and base, is largely eliminated.

The upwardly inclined oven itself presents a problem in view of the tendency of the heat of the heating elements in the oven to rise. In accordance with the present invention, the oven is provided with elongated, spaced, parallel, horizontal heating elements. The heating elements at the lower end of the oven are more closely spaced than the heating elements at the upward end of the oven. With this configuration, the radiant heat applied to the film adjacent the oven opening is not uniform but the convection heat carried up from the more closely spaced heating elements at the lower end of the oven adds to the radiant heat in the upper end of the oven thereby making the total heat applied to the film generally uniform.

Another feature of the invention has been to provide a semi-automatic pneumatic system for raising and lowering the frame. The system includes a ram formed by a piston and cylinder and a pair of valves for selectively controlling the application of air under pressure to both ends of the cylinder to raise and lower the frame with minimal pressure in either direction. Thus, the force on the operator's hand, should it be caught between the frame and the oven or base, will be minimal.

Another feature of the invention, in an alternative embodiment, has been to substitute a pneumatic spring for the semi-automatic pneumatic system for raising and lowering the frame. The pneumatic spring is mounted so as to swing through an over center position to urge the frame toward an upward direction on one side of the over center position and to urge the frame against the base on the other side of the over center position. When the frame is to be swung to a position adjacent the base, that operation is performed manually by the operator.

The several objectives and features of the present invention will become more readily apparent from the following detailed description taken with the accompanying drawings in which.

Figure 1:
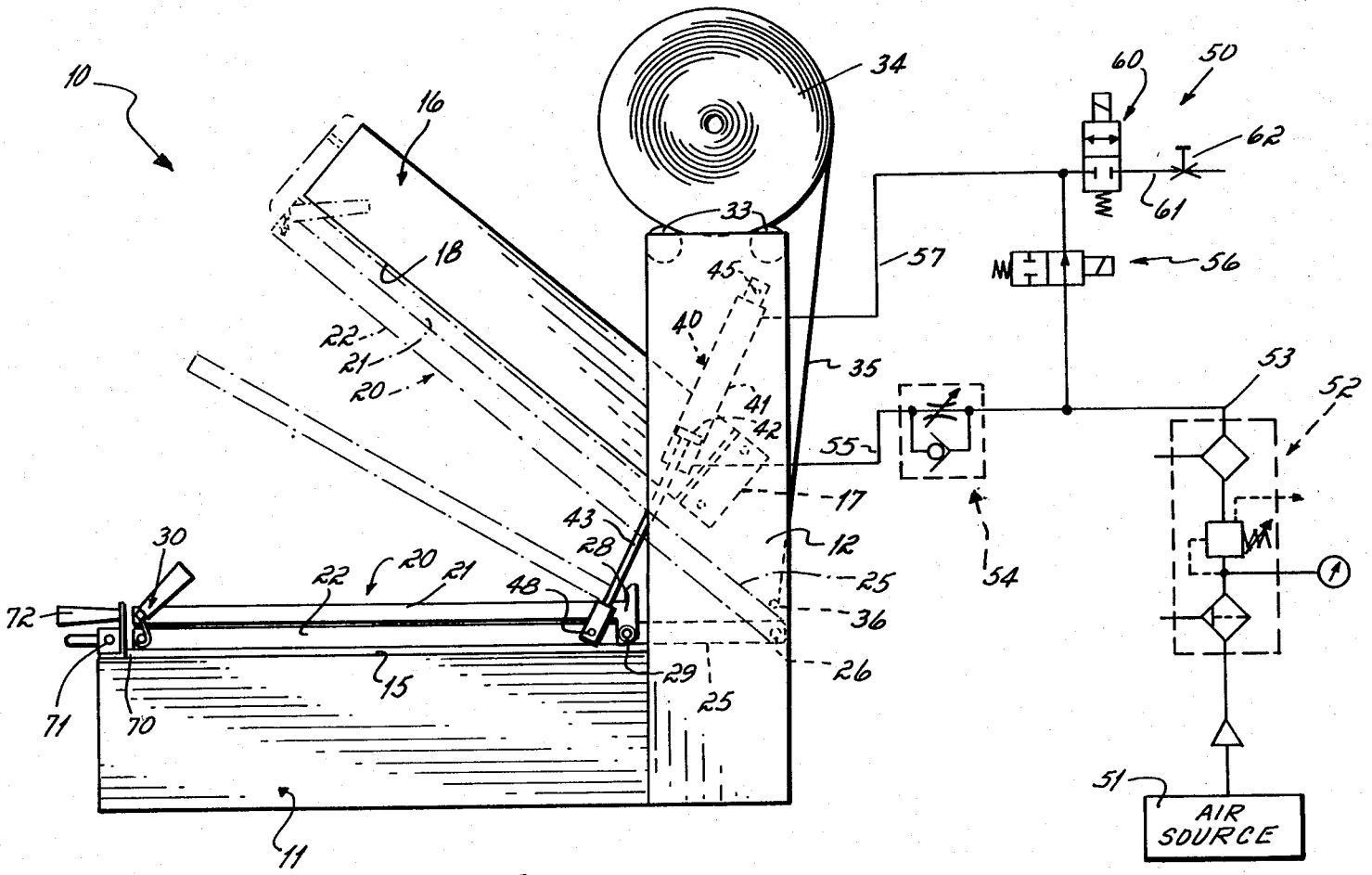
FIG. 1 is a diagrammatic side elevational view of the skin packaging machine of the invention with the pneumatic system for raising and lowering the frame diagrammatically shown.
Figure 2:
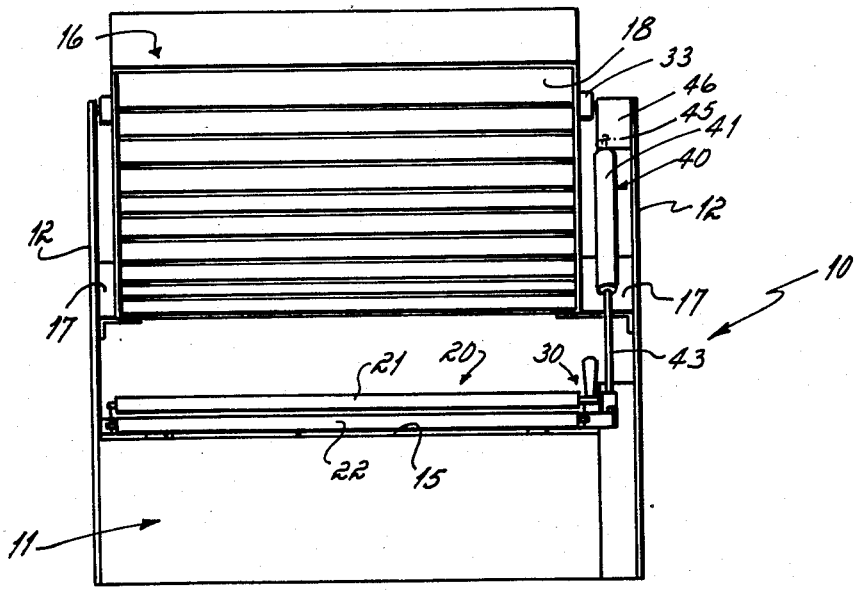
FIG. 2 is a front elevational view of the skin packaging machine.

Referring to FIGS. 1 and 2, the skin packaging machine, shown at 10, includes a base 11, the base including a pair of vertical plates 12 which are spaced apart for supporting other elements of the machine, as will appear below. A formainous plate 15 forms the upper surface of the base. An inclined oven 16 is mounted on brackets 17 between the plates 12. The oven has a downwardly-facing opening 18 which lies at an angle of approximately 40° to the foraminous plate 15 on the base.

A frame or clamp 20 having an upper jaw 21 and a lower jaw 22 is pivotally mounted on the base and is adapted to swing from a horizontal position shown in full line to an upwardly-inclined position shown in phantom lines in FIG. 1. The lower jaw has a rearward extension 25, the rearward end of which is pivoted at 26 between the vertical plates 12. By pivoting the lower jaw and hence the frame on an axis well to the rear of the foraminous surface and the oven, the angle through which the frame must swing and the angle of inclination of the oven can be minimized.

The upper jaw 21 has at its rearward end, a generally L-shaped bracket 28 which is pivoted to the lower jaw 22 to permit the upper jaw to swing from a horizontal position shown in full lines to an upwardly inclined position with respect to the lower jaw as shown in phantom lines in FIG. 1. A torsion spring indicated in phantom lines at 29 is connected between the upper and lower jaws and normally urges the upper jaw toward an open position. A latch mechanism 30 mounted at the forward edge of the upper jaw and cooperating with the forward edge of the lower jaw in order to latch the upper and lower jaws together is provided.

At the upper portion of the vertical plates 12, a pair of trunions 33 are rotatably mounted to support a supply roll 34 of film 35. An idler roller 36 is provided adjacent the rear end of the frame 20 around which the film passes so that the film can be passed between the upper and lower jaws 21 and 22 of the frame 20.

A ram 40 consisting of a cylinder 41, a piston 42 and a piston rod 43 is connected between the base and the frame 20. More specifically, the cylinder 41 is pivotally connected at 45 to a bracket 46 mounted at the upper end to one of the plates 12. The piston rod 43 is pivoted at 48 to the lower jaw of the frame 20.

The cylinder 41 is connected to a pneumatic system 50 to cause the ram to extend in order to lower the frame to the full line position or to retract to raise the frame to the phantom line position of FIG. 1. The pneumatic system includes a source of air 51 under pressure, the air under pressure being connected to a filter, regulator lubricator 52. The regulator 52 is connected through tubing 53 to a flow control valve 54 which is in turn connected through tubing 55 to the rod end of the cylinder 41.

A solenoid operated two-way valve 56 is connected by tubing 57 as well as the tubing 53 and 55 across the cylinder at its rod end and its piston end. A second solenoid operated two-way valve 60 is connected on one side between the first valve 56 and the piston end of the cylinder 40, the other side of the valve 60 being connected at 61 to atmosphere through a needle valve 62.

The operation of the pneumatic system is generally as follows: to extend the ram 40, the first valve 56 is shifted electrically from its normally closed position to its open position (shown). This applies the same regulated air pressure to both sides of the ram 40. The ram 40 extends because of the difference in area of the piston side of the ram versus the rod side of the ram. By operating the cylinder in this manner, the net thrust delivered by the rod extending will be the same as if the air pressure were applied only to the rod area, thereby substantially reducing the force with which the frame 20 will lower. This reduction in force will provide the machine operator with a safety if the frame 20 were lowered onto some part of his body.

To retract the ram 40, the second valve 60 is shifted electrically from its normally closed position (shown) to its open position and valve 56 is closed. This releases the compressed air on the piston side of the cylinder and allows the ram 40 to retract by means of the air pressure on the rod side of the ram flowing through flow control 54, thereby raising the frame 20. The needle valve 62 controls the rate at which air escapes from the piston side of the ram to control the speed at which the frame rises. The filter regulator lubricator 52 is adjusted to the minimum pressure required to raise the frame 20 so that the frame will rise at a force consistent with the operator's safety.

If at any time the machine emergency stop button is pushed, both valves 56 and 60 will return to their normally closed position and the ram will stop at whatever point it is in its travel.

Figure 3:
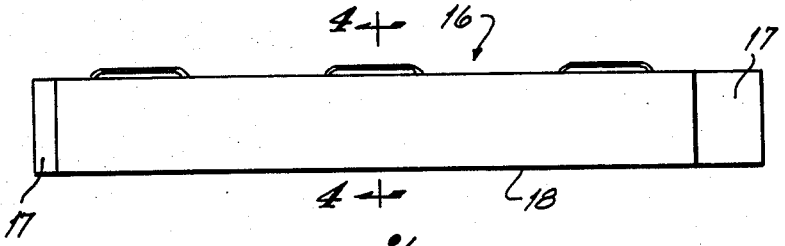
FIG. 3 is a front elevational view of the oven.
Figure 4:
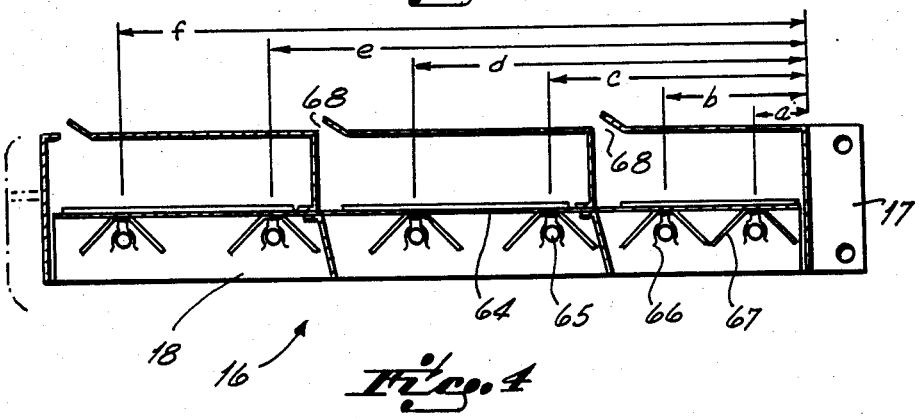
FIG. 4 is a cross-sectional view taken along lines 4—4 of FIG. 3.

The oven, shown in FIGS. 3 and 4, has a generally flat pan-like support 64 containing a plurality of elongated, parallel heating elements 65 set in fuse mounts 66. The heating elements are preferably quartz tubes which are spirally wrapped in Nichrome ribbon as taught in U.S. Pat. No. 3,621,200. Each heating element is backed by a reflector 67. Ventilating vanes 68 may be provided at the reverse side of the oven from the opening 18 or alternatively the reverse side of the oven may be covered with an insulative material.

It can be observed that the heating elements are more closely spaced at the lower end of the oven than at the upper end of the oven in order that the combination of radiant heat from the heating elements and convection heat from air flowing across the face of the oven will provide a more uniform overall heating of the film which is held against the opening of the oven on the frame 20. For a frame which is twenty-one inches wide and twenty-seven inches long, the representative spacing of the heating elements would be as follows:

(a) $1\frac{1}{2}$ inches
(b) $4\frac{1}{8}$ inches
(c) $7\frac{1}{4}$ inches
(d) $10\frac{3}{4}$ inches
(e) $14\frac{5}{8}$ inches
(f) $18\frac{7}{8}$ inches At the front of the machine, provision is made for a knife 70 mounted on a rod 71, the knife having a handle 72. The function of the knife is to sever the film between a completed package and a fresh supply of film brought into the frame 20.

In the operation of the invention, film is drawn into the frame 20 and the frame is raised to the phantom line position. The operator, standing either at the front of the machine or to one side, places a substrate or card which is a porous board on the foraminous plate 15 and an article on top of the substrate. The oven is then energized and the heating elements heat the film until it becomes "droopy." When the film is ready, the pneumatic system is operated to lower the frame gently down upon the base to the full line position illustrated in FIG. 1. Vacuum from a source, not shown, is applied to the foraminous plate which, through the porous substrate, draws the film down upon the substrate. A previously applied adhesive causes the film to adhere to the substrate.

When the package is thus formed, the operator opens the frame by raising the upper jaw to the position shown in phantom lines. The completed package is then drawn from the machine toward the left as viewed in FIG. 1. This operation simultaneously pulls a fresh supply of film over the lower jaw of the frame 20. The upper jaw is lowered to clamp the film between the two jaws and the handle 72 is manipulated to cause the knife to cut across the film between the package and the new supply of film in the frame 20. The controls are then operated to change the position of the valves in order to cause the frame to rise to the phantom line position adjacent the oven and the cycle of operations is repeated.

Figure 5:
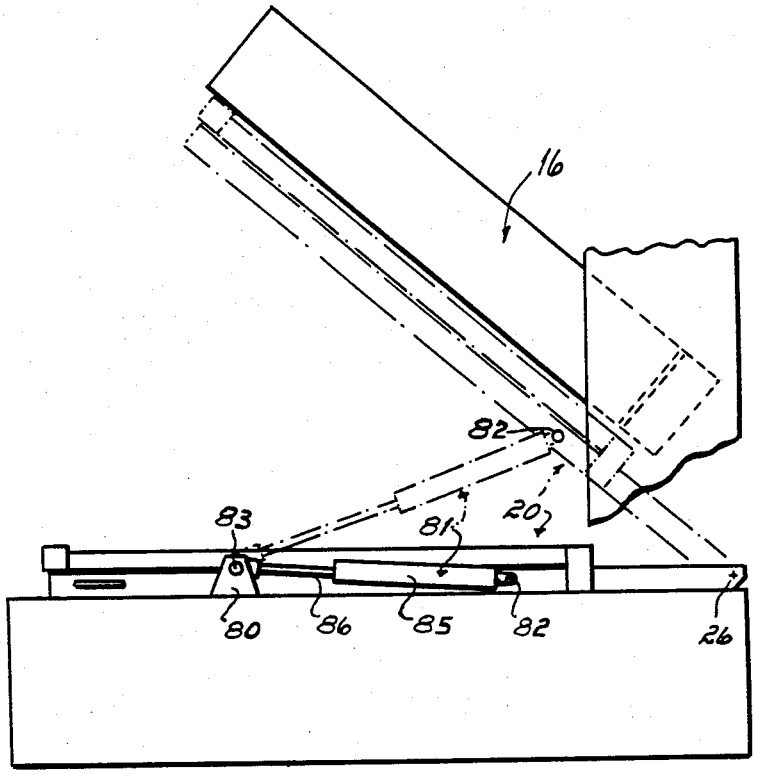
FIG. 5 is a diagrammatic view of an alternative form of the invention.

In an alternative form of the invention as shown in FIG. 5, instead of the ram 40, the apparatus can be provided with a pneumatic spring. In this embodiment, instead of having a pneumatic system with electrically controlled valves, the frame is raised and lowered manually.

As shown in FIG. 5, a bracket 80 is mounted on the base at an elevated position with respect to the pivot axis 26 of the frame 20. A pneumatic spring 81 is pivoted at 82 to the frame and at 83 to the bracket. The pneumatic spring consists of a cylinder 85 containing a compressed gas, a piston rod 86 and a piston (not shown) within the cylinder 85. The compressed gas normally urges the pneumatic spring to an extended position. As shown in phantom lines, the pneumatic spring will urge the frame 20 to an upward position and hold it there against the oven 16. When the frame is manually pulled down against the base 11, the pneumatic spring swings through an over center position in which the three pivot points 26, 82 and 83 are in alignment to the lower position in which the frame 20 lies upon the base 11. In that position, the pneumatic spring urges the frame in a downward direction, thereby holding the frame against the base.

In operation, the operator merely has to lift the frame with sufficient force to overcome the pneumatic spring until the pneumatic spring passes the over center position. Thereafter, the spring moves the frame upwardly. Similarly, to lower the frame, the operator must overcome the force of the pneumatic spring to pull the frame down upon the base 11. When the pneumatic spring passes through the over center position, the spring takes over to complete the movement of the frame onto the base.

Having described my invention, I claim:

1. A skin packaging machine comprising, a base having a horizontal foraminous surface for receiving a porous board and an article to be packaged, an oven mounted above said foraminous surface and having a downwardly-facing planar opening through which heat can be directed, said opening being inclined intermediate a vertical and a horizontal position, a frame adapted to carry a film between positions adjacent said horizontal surface and said oven opening, respectively, means for pivoting said frame to said base on a first axis to swing between said two positions, and a pneumatic spring pivotally connected between said base on a second axis and said frame on a third axis for supporting said frame in an upper position adjacent said oven opening when said frame is swung to said upper position, said pneumatic spring being movable to a first position holding said frame in an upper position wherein a line between said second and third pivot axes is above said first axis, and to a position holding said frame adjacent said horizontal surface wherein said line is below said first axis, whereby to direct the force of said pneumatic spring in such a way as to hold said frame in the desired position after the frame has been moved to the desired position.

* * * * *